US010441994B2

(12) United States Patent
Ore

(10) Patent No.: US 10,441,994 B2
(45) Date of Patent: Oct. 15, 2019

(54) PROTECTING NET

(71) Applicant: Moshe Ore, Alfey Menashe (IL)

(72) Inventor: Moshe Ore, Alfey Menashe (IL)

( * ) Notice: Subject to any disclaimer, the term of this patent is extended or adjusted under 35 U.S.C. 154(b) by 493 days.

(21) Appl. No.: 14/592,070

(22) Filed: Jan. 8, 2015

(65) Prior Publication Data

US 2016/0236264 A1 Aug. 18, 2016

Related U.S. Application Data

(60) Provisional application No. 61/925,247, filed on Jan. 9, 2014.

(51) Int. Cl.
*B21F 27/00* (2006.01)
*B21F 27/08* (2006.01)
*F41H 5/02* (2006.01)

(52) U.S. Cl.
CPC ..... *B21F 27/005* (2013.01); *B21F 27/08* (2013.01); *F41H 5/026* (2013.01)

(58) Field of Classification Search
CPC .... D10B 2505/02; B21F 27/005; B21F 27/08; F41H 5/026
USPC ..... 87/5
See application file for complete search history.

(56) References Cited

U.S. PATENT DOCUMENTS 1,964,419 A * 6/1934 Asten ..... D03D 25/00 139/383 A
2,013,635 A * 9/1935 Serafinowicz ..... E04H 4/0012 4/487
2,125,583 A * 8/1938 Reed ..... B21F 27/005 245/8
2,313,581 A * 3/1943 Reed ..... B21F 27/005 139/383 B
2,810,405 A * 10/1957 Huau ..... D03D 15/00 139/383 R
2,893,442 A * 7/1959 Genin ..... D03D 15/00 139/383 R
2,919,217 A * 12/1959 Bobkowicz ..... B29C 70/202 428/108
3,007,273 A * 11/1961 Eggertsson ..... A01K 75/04 43/9.1
3,017,856 A * 1/1962 Munz ..... A01K 61/54 119/238
3,299,890 A * 1/1967 Parker ..... A61F 13/00038 602/65
3,428,278 A * 2/1969 Glaze ..... B21F 27/005 245/8

(Continued)

OTHER PUBLICATIONS

Teachnical information, Oct. 21, 2014, http://www.alpha-ropes.com/uploads/files/alpharopes_technical_info.pdf.*

*Primary Examiner* — Shaun R Hurley
*Assistant Examiner* — Bao-Thieu L Nguyen
(74) *Attorney, Agent, or Firm* — Perel-Intellectual Property Law

(57) ABSTRACT

A net and method for creating the same, the net comprising: cables in two or more directions, wherein the cables in each of the directions are made of at least a first construct or a second construct, wherein each cable of a first construct in the first direction has neighboring cables in the first direction made of the second construct, and each cable of the first construct in the second direction has neighboring cables in the second direction made of the second construct.

17 Claims, 4 Drawing Sheets

(56) References Cited

U.S. PATENT DOCUMENTS 3,644,165 A * 2/1972 Chen ..... B29C 70/086 156/177
3,744,529 A * 7/1973 Jorda ..... B29C 47/0033 138/125
4,518,640 A * 5/1985 Wilkens ..... D04H 3/002 428/102
5,206,078 A * 4/1993 Inoguchi ..... D03D 1/0082 139/420 A
5,538,781 A * 7/1996 Rao ..... D03D 15/00 139/420 A
5,976,996 A * 11/1999 Howland ..... D03D 1/0052 139/383 R
6,063,716 A * 5/2000 Granqvist ..... A41D 31/0061 428/911
6,193,847 B1 * 2/2001 Trokhan ..... D21F 11/006 162/348
6,233,978 B1 * 5/2001 Gehring, Jr. ..... A41D 31/0055 66/195
6,523,578 B1 * 2/2003 Schneider ..... D03D 9/00 139/420 A
6,548,430 B1 * 4/2003 Howland ..... D03D 1/00 139/383 R
7,073,538 B2 * 7/2006 Bhatnagar ..... D03D 1/0052 139/383 R
7,304,007 B2 * 12/2007 Braekevelt ..... B29C 70/22 428/137
7,351,672 B2 * 4/2008 Johnson ..... B32B 5/26 296/107.01
7,682,994 B2 * 3/2010 Van Emden ..... A41D 31/02 264/103
7,820,565 B2 * 10/2010 van Heerden ..... D03D 1/0052 428/911
7,842,628 B2 * 11/2010 Yasui ..... A41B 17/00 442/181
7,866,250 B2 * 1/2011 Farinella ..... F41H 11/02 296/187.06
8,394,731 B2 * 3/2013 Sato ..... D02G 3/04 428/901
8,501,317 B2 * 8/2013 Miura ..... D01D 11/06 428/364
8,541,090 B2 * 9/2013 Nagelsmit ..... B29C 70/202 428/109
8,871,660 B2 * 10/2014 Yoshizaki ..... B32B 5/12 156/148
9,261,333 B2 * 2/2016 Guo ..... F41H 5/0485
9,277,684 B2 * 3/2016 Laurent ..... H05K 9/0007
2002/0045392 A1 * 4/2002 White ..... D04H 3/04 442/32
2003/0148680 A1 * 8/2003 Cook ..... B01D 39/12 442/1
2004/0221712 A1 * 11/2004 Stewart ..... B32B 5/12 89/36.05
2005/0020157 A1 * 1/2005 Weiser ..... B32B 5/26 442/49
2006/0222837 A1 * 10/2006 Kismarton ..... B29C 70/083 428/297.4
2007/0071941 A1 * 3/2007 Eleazer ..... B29C 70/24 428/92
2007/0141111 A1 * 6/2007 Suokas ..... A61F 2/28 424/426
2007/0180983 A1 * 8/2007 Farinella ..... F41H 5/026 89/36.07
2009/0035068 A1 * 2/2009 Terai ..... B63G 9/04 405/211
2011/0203450 A1 * 8/2011 Carbajal ..... B32B 5/26 89/36.02
2012/0174274 A1 * 7/2012 Maliakal ..... B29C 51/02 2/2.5
2013/0280477 A1 * 10/2013 Davis ..... B32B 5/12 428/109
2016/0023428 A1 * 1/2016 Adams ..... B32B 5/022 442/57
2016/0059516 A1 * 3/2016 Harris ..... B32B 7/12 442/1

* cited by examiner

PROTECTING NET

TECHNICAL FIELD

Embodiments of the disclosure relate to a net for protecting areas from propelled objects.

BACKGROUND

Static objects such as buildings, hangars, store houses or others are sometimes a convenient target for attacks, intended against the building itself, objects stored or human beings staying therein. In some cases, a cluster of buildings, possibly with vehicles in their vicinity, make a convenient target when hitting any of the buildings or targets will satisfy the attacker.

Of particular threat are weapons aimed against such targets, such as shaped charges. For example rocket-propelled grenade (RPG) having an explosive charge shaped so as to focus the effect of the explosive's energy once heating an object, thus utilizing the kinetic energy of the object to create significant effect. Focusing the energy enables such charges to create extensive damage to the hit object, such as demolishing or severely damaging buildings or parts thereof, initiating nuclear weapons, penetrating armor, or the like. For example, a rocket can penetrate a steel armor to a depth significantly larger, than the diameter of the charge, for example around 10 times larger. The operation principle of the rocket uses the Munroe or Neumann effect of focusing the blast energy by a hollow or void cut on a surface of explosive.

Some known protective measures include protective walls or conventional nets made of cross cables having predetermined strength and elasticity. Protective walls are expensive, take a long time to erect, are static and cannot be reused or easily fixed when hit. For protective nets to be effective, such nets have to be made of strong material that would stop the rocket, and are thus expensive, heavy and cumbersome to transport, hard to deploy and fold, and generally inconvenient to use.

SUMMARY

One aspect of the disclosure relates to a net, comprising: cables in two or more directions, wherein the cables in each of the directions are made of at least a first construct or a second construct, wherein each cable of a first construct in the first direction has neighboring cables in the first direction made of the second construct, and each cable of the first construct in the second direction has neighboring cables in the second direction made of the second construct. Within the net, each cable of the second construct in the first direction optionally has neighboring cables in the first direction made of the first construct. Within the net, each cable of the second construct in the second direction optionally has neighboring cables in the second direction made of the first construct. Within the net, the first construct is optionally more flexible than the second construct. Within the net, the first construct optionally comprises elastic fibers therein. Within the net, the second construct optionally comprises rigid fibers therein. Within the net, the second construct optionally comprises metal fibers therein. Within the net, the first direction and the second direction are optionally perpendicular to each other. Within the net, each opening in the net optionally has two adjacent sides of the first construct and two adjacent sides of the second construct. Within the net, cables are optionally combined to each other using a technique selected from the group consisting of: sewing, stitching, gluing, welding, patching, connecting stripes, knots, thermally-activated connecting materials and braces.

Another aspect of the disclosure relates to a method for creating a net, comprising: creating a first partial net made of a first construct; creating a second partial net made of a second construct; and combining the first and second partial nets at an offset to create a net. Within the method, each opening in the net optionally has two adjacent sides of the first construct and other two adjacent sides of the second construct. Within the method, the first construct is optionally more flexible than the second construct. Within the method, the first construct optionally comprises elastic fibers therein. Within the method, the second construct optionally comprises rigid fibers therein. Within the method, the second construct optionally comprises metal fibers therein. Within the method, the first and second partial nets are optionally combined using a technique selected from the group consisting of: sewing, stitching, gluing, welding, patching, connecting stripes, knots, thermally-activated connecting materials and braces.

Yet another aspect of the disclosure relates to a method for creating a net, comprising: alternately attaching cables of a first construct and cables of a second construct in a first direction, to a cable in a second direction; and alternately attaching cables of the first construct and cables of the second construct in the second direction. Within the method, each opening in the net optionally has two adjacent sides of the first construct and other two adjacent sides of the second construct. Within the method, the first construct is optionally more flexible than the second construct.

BRIEF DESCRIPTION OF THE SEVERAL VIEWS OF THE DRAWINGS

Exemplary embodiments are illustrated in referenced figures. Dimensions of components and features shown in the figures are generally chosen for convenience and clarity of presentation and are not necessarily shown to scale. It is intended that the embodiments and figures disclosed herein are to be considered illustrative rather than restrictive. The figures are listed below.

DETAILED DESCRIPTION

Figure 1:
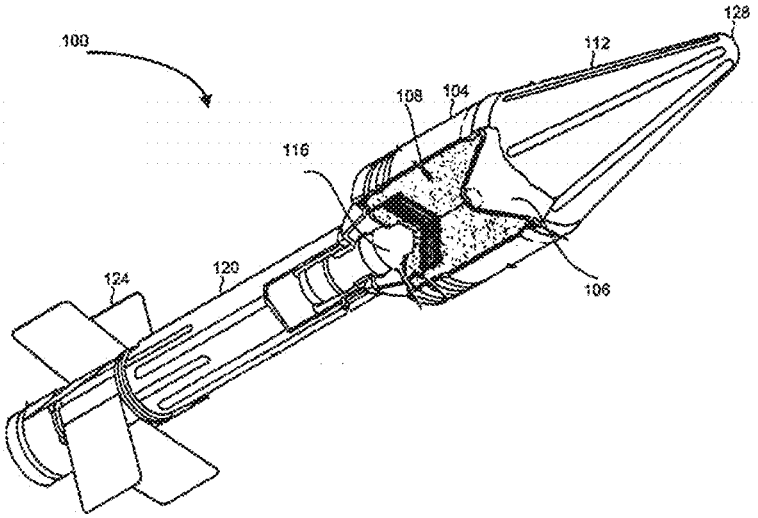
FIG. 1 shows a cutaway drawing of a shaped charge.

An aspect of some embodiments relates to a net for protecting against propelled objects, such as shaped charges or objects containing explosive materials. The net can be deployed at a distance from building vehicles, human beings or other targets to be protected, such that the net crosses expected trajectories of propelled objects that endanger the buildings. For example, the farther are the propelled objects launched from, the higher is the peak of their expected trajectory, and therefore their descend is steeper and the net should be deployed closer to the target.

Although the description below concentrates on a net having four-sided holes, such as rectangular or square holes, it will be appreciated that the disclosure relates to other structures as well, including but not limited to structures having polygon-shaped holes.

The net comprises cables, also referred to as straps, belts or stripes in two or more directions, for example but not limited to horizontal and vertical directions or other substantially perpendicular directions, or any other directions in an angle to one another. The cables may be substantially round and small relatively to the spaces therebetween, similarly to ropes, or the cables may be substantially planar similar to straps, and occupy a significant part of the total area of the net. The cables in at least some of the directions are made of two or more materials, material combinations or constructs, and are arranged such that each cable of a first construct in the first direction has neighboring cables on both sides in the same direction made of the second construct, and each cable of a second construct in the first direction has neighboring cables in the same direction made of the first construct. The same holds also for the second direction. This excludes the side cables which naturally have neighbors only on one side. This construct generates a net having a grid of openings, in which each opening has two adjacent sides of a first construct and other two sides of a second construct.

For example, the net may be made of two nets made of different materials or material combination, and combined together such that each horizontal cable (possibly excluding the first and last horizontal cables) of one net are placed between two horizontal cables of the other net, and similarly for the vertical cables. Thus, the area of the net is divided into square or rectangles, wherein each such square or rectangle has two adjacent sides made of a first material or material combination, while the other two sides, which are adjacent to each other, are made of a second material or material combination.

The first net and therefore the first two sides of each rectangle may be made of a more elastic or resilient material than the other net and the other two sides of each rectangle.

Some nets may be designed to have non-rectangular holes such as polygonal holes. Such nets may be made such that the holes have any number of sides in any number of directions. Even further, not all holes need to be identical and the net may comprise holes of different sizes or different shapes. In such nets, each hole needs to have at least two pairs of adjacent sides, wherein one such pair is made of a more elastic material or material combination than the other pair. Thus, an object hitting the net would tend towards the more elastic area. Such net may be made of any number of sides in any number of directions.

The net may be constructed such that at least two parallel sides of each square or rectangle are smaller than the largest diameter of the propelled objects expected to hit it, for example smaller than the nose or wing span of the propellers. With this structure, no matter which rectangle of the net is hit by the propelled object, the trajectory of the object is turned towards the more elastic sides of the rectangle and away from the other two sides, made of less elastic materials. Thus, the propelled object is shifted from its original trajectory. For a net with non-rectangular holes, each hole may have to be designed such that the largest crossing line in at least one direction is smaller than the nose or wing span of the object.

Due to the distance between the target and the net, even such turn or shift in the trajectory which may be of a small angle, may be enough to divert the propelled object away from the target, for example towards an open area.

In addition, the object, such as the shaped charge may explode when hitting the net, thus avoiding hitting the target. Yet another scenario relates to one or more of the propellers of the shaped charge getting hit and broken by any of the edges of a rectangle of the net, which results in the rocket losing its driving force and falling to the ground at a small distance after crossing the net.

The net, being partially made of elastic materials rather than more rigid ones, may provide for lighter and more flexible structure than conventional nets, which is easier to transport and deploy.

The met may be deployed by hanging it, for example by connecting two of its corners to poles, and fastening the other two corners, for example to the lower parts of the poles.

Referring now to FIG. 1, showing a cutaway drawing of a shaped charge, generally referenced 100. The shaped charge comprises a body 104 having therein conical liner 106 surrounded by main charge 108, nose cap 112 having an aerodynamic shape, and within which is an air cavity, detonator 116, stabilizer tube 120 and two or more, typically four propeller wings 124. Nose cap 112 may have at its end 128 a sensor such as a piezo-electric sensor.

When the piezo electric sensor senses touch, for example when the rocket hits a target or another object, it detonates detonator 116, which pushes main charge 108 forward. The pressure generated by the detonation of the explosive drives liner 106 inward to collapse upon its central axis. The resulting collision forms and projects a high-velocity jet of melted metal particles moving sprayed or otherwise moving forward along the axis. Most of the jet material originates from the innermost part of the liner, a layer typically of about 10% to 20% of the thickness. The rest of liner 106 forms a slower-moving slug of material. Because of the variation along the liner in its collapse velocity, the jet's velocity also varies along its length, decreasing from the front. This variation in jet velocity stretches it and eventually leads to its break-up into particles.

The penetration manner of the rocket into the target, whether it is a building, a vehicle, or the like, highly depends on the location of the charge relative to its target. If the charge is detonated too close, there is not enough time for the jet to fully develop, such that the jet disintegrates and disperses after a relatively short distance. It may then break into particles which tend to tumble and drift off the penetration axis, so that successive particles tend to widen rather than deepen the penetration hole. A key to the effectiveness of the charge is its diameter. In general, shaped charges can penetrate a basic steel plate as thick as 150% to 700% of their diameter, depending on the charge quality.

Thus, the effect of a shaped charge is often a relatively small penetration hole or area in the hit target whether it is a building, a vehicle, or the like, wherein the small penetration hole is created by the high velocity, and a significant damage inside the target, caused by the high volume of the slower-moving material.

Figure 2A:
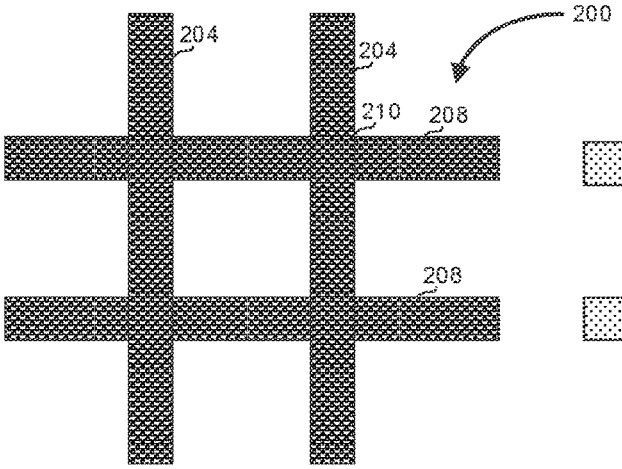
FIGS. 2A and 2E are schematic illustrations of partial nets, in accordance with some exemplary embodiments of the disclosure.
Figure 2E:
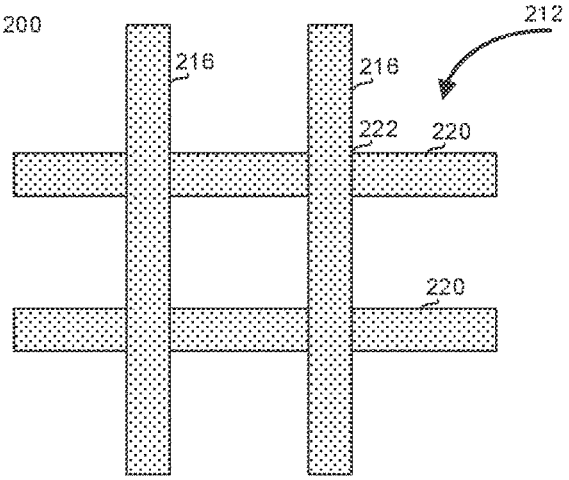

Referring now to FIGS. 2A and 2E, showing schematic illustrations of two partial nets.

FIG. 2A shows a first net, generally referenced 200 and FIG. 2E shows a second net generally referenced 212. Net 200 comprises vertical cables 204 and horizontal cables 208, and net 212 comprises vertical cables 216 and horizontal cables 220.

Net 200 may have substantially the same distance between any two horizontal cables 208 as the distance between any two horizontal cables 220 of net 212, and similarly for the vertical cables 214 of net 200 and 216 of net 212.

Net 200 and net 212 may be made of different materials or constructs, such that one of them, for example net 200 is more elastic or resilient than the other. For example, net 200 may be made of strong fabric with Lycra® LYCRA®, gum or latex fibers to ensure its flexibility and stretching when hit. Net 212, however, may be made of stronger and less rigid material such as fabric with internal metal wires or strong fibers, such as nylon or polyester, such that it is not stretchable.

The horizontal and vertical cables may be attached to each other at junctions such as junctions 210 and 222 by sewing, stitching, gluing, adding metal nits, patches, connecting stripes, knots, thermally-activated connecting materials, braces if any material, or the like, designed to permanently or temporarily attach the cables firmly or loosely to each other.

Figure 2B:
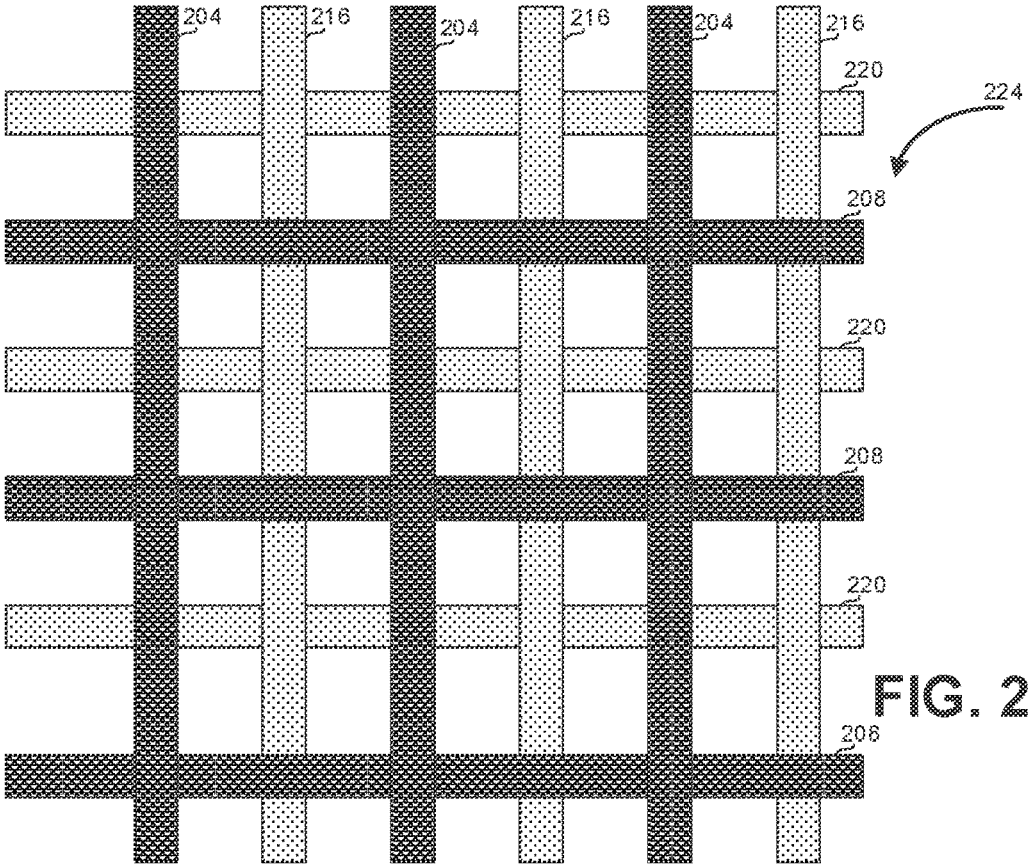
FIG. 2B is a schematic illustration of a protective net made of the partial nets shown in FIG. 2A, in accordance with some exemplary embodiments of the disclosure.

Referring now to FIG. 2B, showing a schematic illustration of a protective net made of the partial nets shown in FIG. 2A.

The net, generally referenced 224, comprises nets 200 and 212 combined at an offset, such that each horizontal cable 208 of net 200 is placed between two horizontal cables 220 of net 212, each horizontal cable 220 of net 212 is placed between two horizontal cables 208 of net 200, each vertical cable 216 of net 212 is placed between two vertical cables 204 of net 200, and each vertical cable 204 of net 200 is placed between two vertical cables 216 of net 212. The side cables of each net are, of course, exceptions to this construct.

Net 224 may be constructed such that each square or rectangle formed by cables 204, 208, 212 and 216 has at least one dimension smaller than the wing span of rockets expected to attack the target, for example between 3 and 10 cm, e.g. 4 cm.

It will be appreciated that the width of horizontal cables 208 and 220 may or may not be the same, and similarly for horizontal cables 204 and 216. However, in some embodiments the distance between the beginnings, for example the topmost part, of two horizontal cables 208 is substantially the same as the corresponding distance between two horizontal cables 220, and similarly for vertical cables 204 and 216.

It will also be appreciated that each horizontal cable of one net nay be placed substantially in the middle between two horizontal cables of the other net and similarly for the vertical cables. However, other arrangements may be designed, as long as the resulting holes of the combined net are of sufficiently small dimensions to be effective.

The used materials and the exact dimensions may be determined in accordance with the strength required of both nets, pricing limitations, required size, weight requirements which affect transport costs and deployment complexity, and possibly additional factors.

It will be appreciated that production of the net of FIG. 2B may require the production of two separate nets and then combining them. Alternatively, the net can be made by combining alternating horizontal cables and alternating vertical cables.

Each opening of net 224 is surrounded by one horizontal cable 208, one horizontal cable 220, one vertical cable 204 and one vertical cable 216, such that each such square has two adjacent sides belonging to net 200 having its respective characteristics, and two adjacent sides belonging to net 212, having its respective characteristics. Thus, when an object such as a propelled object hits net 224 at any such rectangle, it will be shifted towards the weaker and more resilient edges, which may cause its trajectory to divert.

Figure 2C:
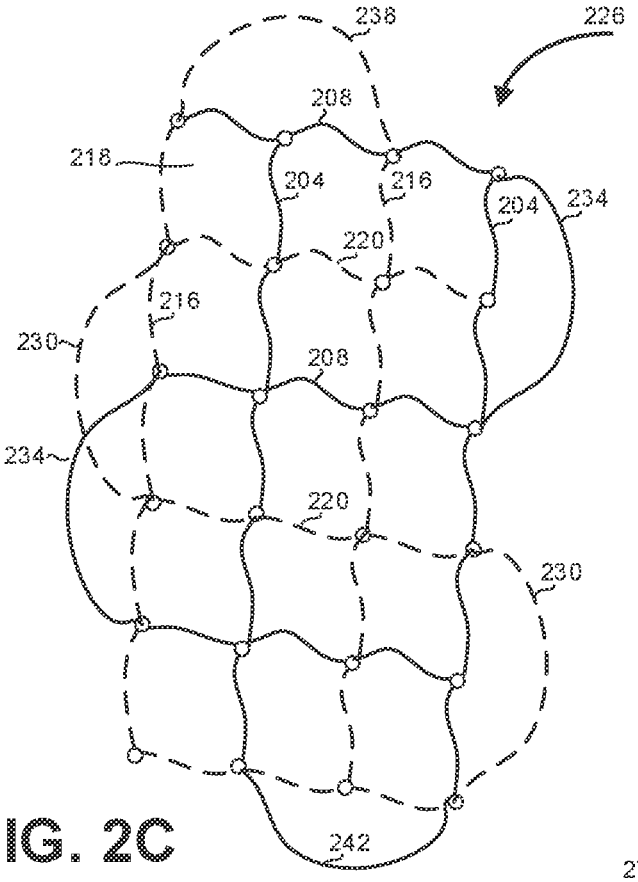
FIG. 2C is an illustration of a portion of a protective net, in accordance with some exemplary embodiments of the disclosure.
Figure 2F:
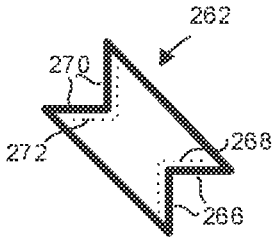
FIGS. 2D and 2F-2J are illustrations of different junction types and methods for connecting nets at the junction, in accordance with some exemplary embodiments of the disclosure.

Referring now to FIG. 2C, showing an illustration of a portion of a protective net. The net, generally referenced 226 comprises alternating horizontal members 208 and 220, alternating vertical members 204 and 216, wherein horizontal members 208 and vertical members 204 are more rigid and horizontal members 220 and vertical members 216 are more flexible. The members may be stripes, cables, or the like. The more rigid network, consisting of horizontal members 208 and vertical members 204 may be constructed with an inner space, such that a rigid member, such as metal cable 238 may be inserted therein, and may go back and forth and traverse horizontal members 208 and vertical members 204. The two ends of rigid cable 238 may connect to each other, as indicated in area 242. The ends may be connected using a knot, welding, patch, a wrapping member, or any other connection method.

The handles formed when rigid cable 238 is outside any of the horizontal or vertical cables, such as handles 230 or 234 may be used for stretching and hanging net 216 on poles or on any appropriate structure.

It will be appreciated that the disclosure also covers methods for creating such net, including creating two partial nets, wherein one partial net is of a first construct or material and the other is of another construct or material. The net is then created by combining the two partial nets at an offset such that each opening in the combined net has two adjacent sides of the first construct and other two adjacent sides of the second construct.

Alternatively, the net may be created by alternately attaching cables of one construct and cables of the other construct in a first direction to a cable in the other direction, and then alternately attaching cables of the first construct and cables of the other construct in the other direction.

The horizontal and vertical cables of the two nets may be attached to each other at junctions by sewing, stitching, gluing, adding metal nits, patches, connecting stripes, knots, thermally activated connecting materials, braces of any material, or the like, designed to permanently or temporarily attach the cables firmly or loosely to each other.

Referring now to FIGS. 2D and 2F-2J, showing a part of the net shown in FIG. 2B and attachment of the nets.

Figure 2D:
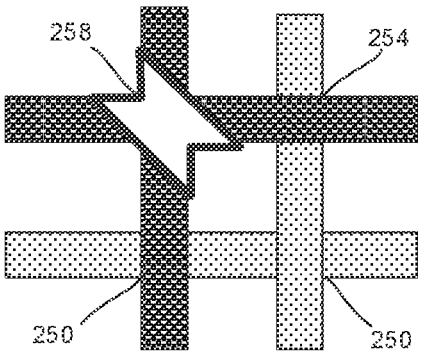

FIG. 2D shows junctions of three types: elastic-elastic junction 250, elastic-rigid junctions 254 and rigid-rigid junction 258.

Figure 2G:
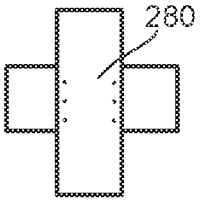
Figure 2H:
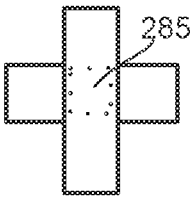
Figure 2I:
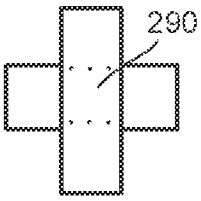
Figure 2J:
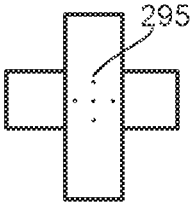

Elastic-elastic junction 250 may be connected by sewing, stitching, or the like, wherein the stitches may be along any one or more of the four sides of the junctions, as shown in junctions 280 of FIG. 2G, 285 of FIG. 2H or 290 of FIG. 2I, in the central area of the junction such as shown in junction 295 of FIG. 2J, or anywhere else on or near the junction.

Elastic-rigid junctions 254 may also be connected by sewing or stitching along the softer sides of the junction or along other sides or other lines of the junction which do not cross the rigid cables.

All junction types may be connected by gluing, connecting by metal nits or the like. Additionally or alternatively, all junctions and in particular rigid–rigid junctions 258 may be connected using a specifically designed connector, for example as shown in 262 of FIG. 2F which may be made of any strong material connectable by sewing, gluing, welding, nailing, or the like. The connector itself may be made of two pieces shaped as shown in 262. It will be appreciated that the connector may be designed and implemented in multiple other ways, including different shapes and different connection manners, and is not limited to the example of connector 262.

In the shown exemplary embodiment, two sides 266 of the shapes may be pre-sewed such as shown by stitch 268. The connector may then be placed around a junction and its two other sides 270 may be sewn as shown by stitch 272. Stitch 272 can sew together connector sides 272, and may also sew the sides of the junction. Thus, stitch 272 can be external to the junction or on the junction.

It will be appreciated that the disclosure is not limited to the disclosed examples and multiple other connection methods or connectors may be designed.

Figure 3:
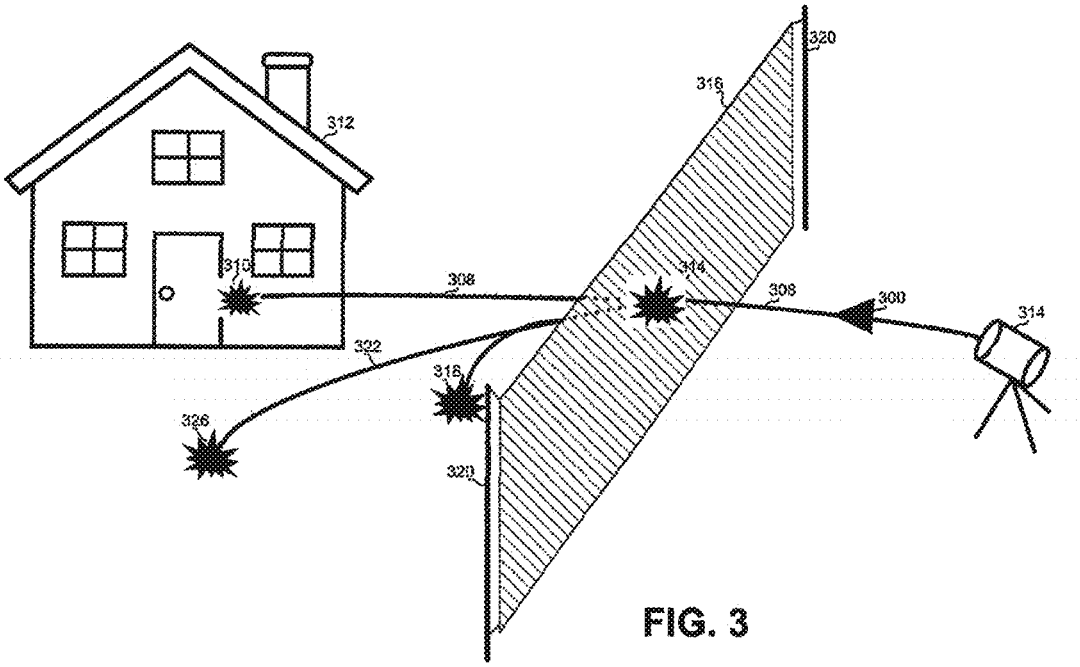
FIG. 3 is a schematic of a target, a protective net and its mode of operation, in accordance with some exemplary embodiments of the disclosure.

Referring now to FIG. 3 showing a schematic of a deployed protective net and its mode of operation.

A rocket 300 is launched from a rocket launcher 314, and if not interrupted would follow trajectory 308 to target 312 and would penetrate it at area 310.

Net 316, which is placed so as to cross trajectory 308 at area 314 is constructed in accordance with the guidelines disclosed above, such that each hole of net 316 has two adjacent sides which are more flexible than the other two adjacent sides. Net 316 may be deployed by hanging it between poles 320.

When rocket 300 hits net 316, a number of scenarios may occur. First, the rocket may explode on the net at crossing area 314, which will prevent the rocket from hitting target 312.

In another scenario, one or more of the wings of rocket 300 may break due to the hitting of any of the cables making up net 316, and in particular if hit by an edge made of the stronger material. Having one or more wings broken, the rocket will lose its momentum and will fall and optionally explode at area 318. In yet another scenario, rocket 300 will not break, but due to hitting an asymmetrical rectangle or square as described above, will have its trajectory diverted from the original trajectory, for example into trajectory 322. Since target 312 is at a distance of tens to thousands of meters from net 316, even a very small diversion in the trajectory will result in a significant change in the end point, such that rocket 300 will not hit target 312 but rather area 326. In addition, even if rocket 300 is not broken by net 316, it may still be slowed down significantly, thus also reducing the potential damage.

The disclosed subject matter relates to an asymmetrical net in which each of its openings, which may be rectangular, square or of any other shape, is surrounded by cables of at least two different materials or material combination, having different elasticity, flexibility, or strength properties. Thus, when a rocket hits the net, it turns towards the more elastic sides, and its trajectory may be diverted such that the target may not be hit.

Due to the net being made of two materials or two material combination, one of which is required to be more elastic and the other one stronger, at least one of the materials or material combination may be of lighter weight, and may thus provide for significantly reducing the overall weight of the net per area unit.

Reduced weight may provide for reduced transportation costs, easier deployment and displacement, or any other handling or maintenance.

It will be appreciated that if the net is hit and damaged by a rocket, a corresponding patch may be used to amend the damaged area so that there is no need to displace the net and employ another one. The patch may be attached to the net by matching corresponding junctions, such that the amended net functions as the original one.

The figures illustrate the architecture, functionality, and operation of possible implementations of systems and devices according to various embodiments of the present disclosure. In this regard. It should also be noted that, in some alternative implementations, the functionality provided by the different components may be achieved using similar or other components, different materials or different dimensions without deviating from the principles of the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Any combination of one or more components may be utilized.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed.

Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A net, comprising:

a first partial net comprising cables of at least a first construct in at least a first direction and a second direction, wherein a first cable at the first direction and a second cable at the second direction, the first cable and the second cable made of the first construct, are connected at a first junction; and a second partial net comprising cables of at least a second construct in the first direction and the second direction, wherein a third cable at the first direction and a fourth cable at the second direction, the third cable and the fourth cable made of the second construct, are connected at a second junction, and wherein the first partial net and the second partial net are connected at an offset, wherein the second construct is more rigid than the first construct, and wherein the cables of the second construct comprise an inner space and metal cable within the inner space, wherein all internal cables of the first construct in the first direction have immediately neighboring cables on both sides in the first direction made of the second construct, all internal cables of the first construct in the second direction have immediately neighboring cables on both sides in the second direction made of the second construct, and the cables of the first partial net are on one side of the second partial net, and the cables of the second partial net are on one side of the first partial net, and the first direction is parallel to the third or the fourth direction, and the second direction is parallel to the fourth or the third direction, respectively.

2. The net of claim 1 wherein the first construct is more flexible than the second construct.

3. The net of claim 1 wherein the first construct is more elastic than the second construct.

4. The net of claim 1 wherein the first construct comprises Spandex, rubber or Latex fibers therein.

5. The net of claim 4 wherein the second construct comprises metal fibers therein.

6. The net of claim 1 wherein the first direction and the second direction are perpendicular to each other.

7. The net of claim 1 wherein each opening in the net has two adjacent sides made of cables of the first construct and two adjacent sides made of cables of the second construct.

8. The net of claim 1 wherein cables are combined to each other using a technique selected from the group consisting of: sewing, stitching, gluing, welding, sewing a patch, connecting stripes, knots, thermally-activated connecting materials and braces.

9. The net of claim 1 wherein the first cables and the second cables divide the net area into rectangles.

10. A method for creating a net, comprising:

creating a first partial net made of a first construct, wherein cables in the first partial net going in different directions are connected at first junctions;

creating a second partial net made of a second construct, wherein cables in the second partial net going in different directions are connected at second junctions, wherein the second construct more rigid than the first construct, and wherein the cables of the second construct comprise an inner space and a metal cable within the inner space; and after the first partial net and the second partial net are created, combining the first and second partial nets at an offset to create a net, such that the cables of the first partial net are on one side of the second partial net, and the cables of the second partial net are on one side of the first partial net, the first direction is parallel to the third or the fourth direction, and the second direction is parallel to the fourth or the third direction, respectively, all internal cables of the first construct in the first direction have immediately neighboring cables on both sides in the first direction made of the second construct, and all internal cables of the first construct in the second direction have immediately neighboring cables on both sides in the second direction made of the second construct.

11. The method of claim 10 wherein each opening in the net has two adjacent sides of the first construct and other two adjacent sides of the second construct.

12. The method of claim 10 wherein the first construct is more flexible than the second construct.

13. The method of claim 12 wherein the first and second partial nets are combined using a technique selected from the group consisting of: sewing, stitching, gluing, welding, sewing a patch, connecting stripes, knots, thermally-activated connecting materials and braces.

14. The method of claim 10 wherein the second construct is more flexible than the first construct.

15. The method of claim 10 wherein the first construct comprises Spandex, rubber or Latex fibers therein.

16. The method of claim 15 wherein the second construct comprises metal fibers therein.

17. The method of claim 10 wherein the first cables and the second cables divide the net area into rectangles.

* * * * *